US006962144B2

(12) United States Patent
Chretien et al.

(10) Patent No.: US 6,962,144 B2
(45) Date of Patent: Nov. 8, 2005

(54) FUEL INJECTION DEVICE FOR AN INTERNAL COMBUSTION ENGINE

(75) Inventors: Laurent Chretien, Lyons (FR); Regis Blanc, Tassin (FR)

(73) Assignee: Robert Bosch GmbH, Stuttgart (DE)

( * ) Notice: Subject to any disclaimer, the term of this patent is extended or adjusted under 35 U.S.C. 154(b) by 96 days.

(21) Appl. No.: 10/311,882

(22) PCT Filed: Apr. 12, 2002

(86) PCT No.: PCT/DE02/01369

§ 371 (c)(1),
(2), (4) Date: Aug. 22, 2003

(87) PCT Pub. No.: WO02/086308

PCT Pub. Date: Oct. 31, 2002

(65) Prior Publication Data

US 2004/0025841 A1 Feb. 12, 2004

(30) Foreign Application Priority Data

Apr. 24, 2001 (DE) ..... 101 19 982

(51) Int. Cl.[7] ..... F02M 37/04
(52) U.S. Cl. ..... 123/499; 123/514
(58) Field of Search ..... 123/509, 470, 123/495, 506, 514, 490, 499; 73/119 A; 239/533.2, 102.2, 585

(56) References Cited

U.S. PATENT DOCUMENTS

| | | | | |
|---|---|---|---|---|
| 5,331,730 A | * | 7/1994 | Brinn, Jr. | 29/606 |
| 5,581,871 A | * | 12/1996 | Yasuno | 29/606 |
| 5,732,888 A | | 3/1998 | Joerg et al. | |
| 5,829,413 A | * | 11/1998 | Rodriguez-Amaya | 123/506 |
| 6,021,762 A | * | 2/2000 | Zeidler et al. | 123/509 |
| 6,164,266 A | * | 12/2000 | Just et al. | 123/506 |

FOREIGN PATENT DOCUMENTS

| | | |
|---|---|---|
| DE | 3 905 992 | 9/1989 |
| DE | 19 641 785 | 4/1998 |
| DE | 19 653 055 | 5/1998 |
| WO | WO 02 086 308 | 10/2002 |

* cited by examiner

*Primary Examiner*—Mahmoud Gimie
(74) *Attorney, Agent, or Firm*—Ronald E. Greigg

(57) ABSTRACT

The fuel injection system has least one magnet valve for controlling the fuel injection. The magnet valve is triggered by an electric control unit and has a magnet coil, a movable pistonlike magnet armature by which a valve member is movable between at least two positions, a magnetic disk by which the magnet armature is attracted when current flows through the magnet coil, and a cup-shaped capsule into which the magnet armature dips. The magnet armature is guided at least indirectly displaceably via its outer jacket in the capsule.

14 Claims, 2 Drawing Sheets

22
14
18
55
54
56
59
50
52
10
16
64
65
20
58
62
46
44
26
48
30
29
40
28
42
38
12
34
36
32

FUEL INJECTION DEVICE FOR AN INTERNAL COMBUSTION ENGINE

CROSS-REFERENCE TO RELATED APPLICATIONS

This application is a 35 USC 371 application of PCT/DE 02/01369 filed on Apr. 12, 2002.

BACKGROUND OF THE INVENTION

1. Field of the Invention

The invention is directed to an improved fuel injection system for an internal combustion engine.

2. Description of the Prior Art

One fuel injection system of the type with which the invention is concerned is known from German Patent DE 196 53 055 C1. This fuel injection system has a magnet valve for controlling the fuel injection. By means of the magnet valve, a communication of a work chamber of the fuel injection system with a relief chamber is controlled, and the magnet valve is open when without current, so that the work chamber communicates with the relief chamber and a high pressure for a fuel injection cannot build up in it. When current is supplied, the magnet valve closes, so that the work chamber is disconnected from the relief chamber, and high pressure builds up in it and a fuel injection takes place. The magnet valve is triggered by an electric control unit and has a magnet coil and a movable magnet armature. The magnet armature is connected to a valve member, by which the communication with the relief chamber is controlled. The magnet valve furthermore has a magnetic disk, by which the magnet armature is attracted when current flows through the magnet coil. A bolt is press-fitted into the magnet armature; it protrudes into a bore in the magnetic disk is and is guided displaceably therein. Thus the magnet armature is guided displaceably in the bore of the magnetic disk via the bolt, and the guidance of the magnet armature perpendicular to an end face, toward the magnet armature, of the magnetic disk must be accomplished with the greatest possible accuracy, in order to make it possible to dispose the magnet armature at the least possible spacing from the magnetic disk, without causing it to contact the magnetic disk. The structure of the magnet valve, with the bolt press-fitted into the magnet armature and with its guidance in the bore of the magnetic disk, is complicated and thus results in high costs.

SUMMARY OF THE INVENTION

The fuel injection system of the invention has the advantage that the magnet armature itself is guided in the capsule, so that the magnet valve has a simple, economical structure.

Other advantageous features of and refinements to the fuel injection system of the invention are disclosed, including means by which wear to the magnet armature is avoided.

BRIEF DESCRIPTION OF THE DRAWINGS

A plurality of exemplary embodiments of the invention are described herein below, with reference to the drawings, in which.

DESCRIPTION OF THE PREFERRED EMBODIMENTS

Figure 1:
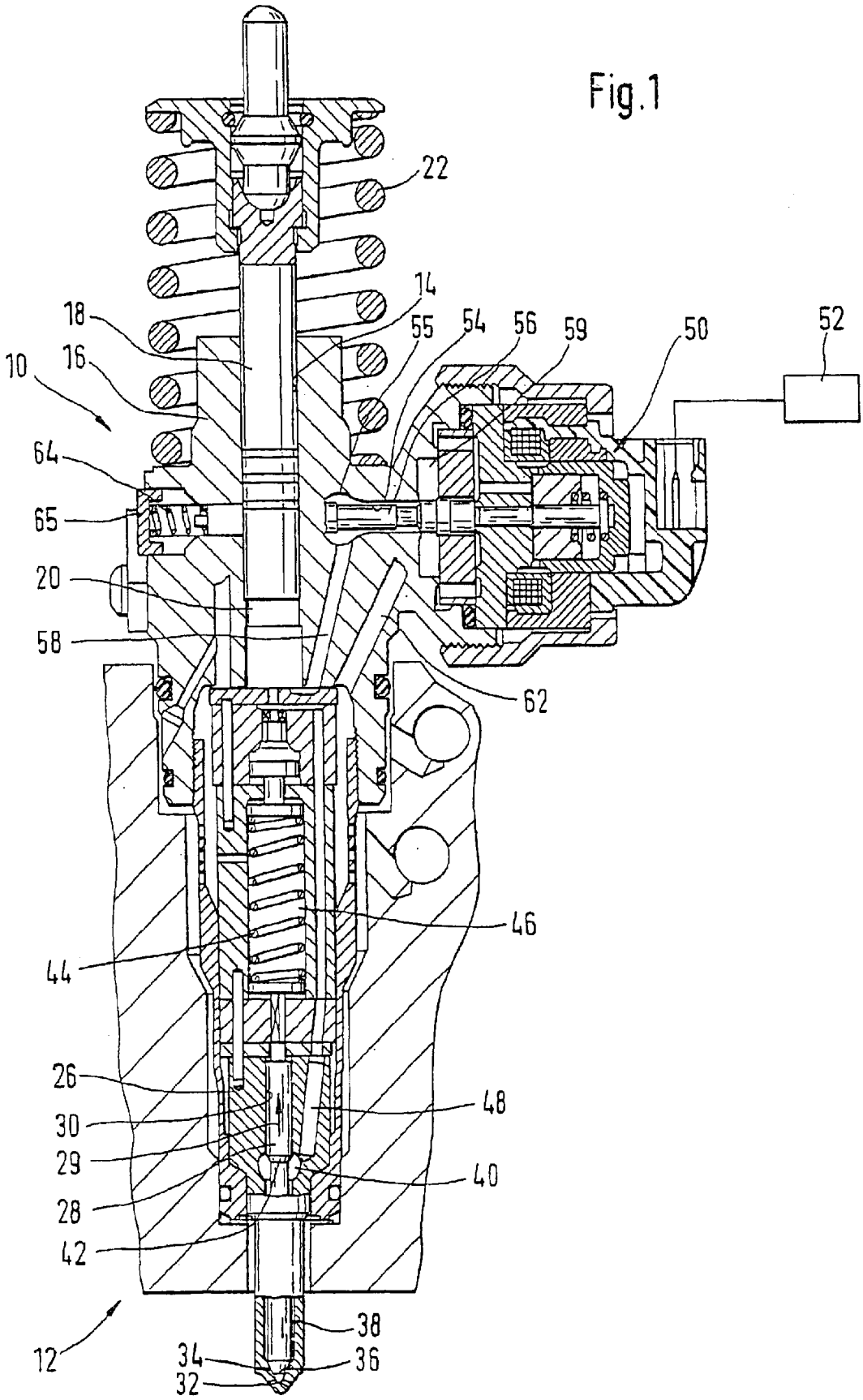
FIG. 1 shows a simplified view of a fuel injection system for an internal combustion engine, with a magnet valve.

In FIG. 1, a fuel injection system for an internal combustion engine, in particular of a motor vehicle, is shown. The fuel injection system has a fuel pump 10 and a fuel injection valve 12, which are combined into a common unit and form a so-called unit fuel injector, which is inserted into a bore in the cylinder head of the engine, with the fuel injection valve 12 protruding into the combustion chamber of a cylinder of the engine. The fuel pump 10 has a pump piston 18, guided axially displaceably in a cylinder body 14 of a pump body 16, and in the cylinder bore 14, the pump piston defines a pump work chamber 20, in which fuel is compressed at high pressure in the pumping stroke of the pump piston 18. Fuel from a fuel supply container is delivered to the pump work chamber 20 in the intake stroke of the pump piston 18. The pump piston 18 is driven in a reciprocating motion by a cam drive, not shown in detail, of the engine, counter to the force of a restoring spring 22.

The fuel injection valve 12 has a valve body 26, which may be embodied in multiple parts and which is connected to the pump body 16. In the valve body 16, an injection valve member 28 is guided longitudinally displaceably in a bore 30. The bore 30 extends at least approximately parallel to the cylinder bore 14 of the pump body 16, but it can also be inclined to it. The valve body 26, in its end region toward the combustion chamber of the cylinder, has at least one and preferably a plurality of injection openings 32. The injection valve member 28, in its end region toward the combustion chamber, has a sealing face 34, which for instance is approximately conical and which cooperates with a valve seat 36, also for instance approximately conical, embodied in the valve body 26 in its end region toward the combustion chamber; the injection openings 32 lead away from or downstream of this valve seat.

In the valve body 26, between the injection valve member 28 and the bore 30, toward the valve seat 36, there is an annular chamber 38, which in its end region remote from the valve seat 36 changes over, as a result of a radial enlargement of the bore 30, into a pressure chamber 40 surrounding the injection valve member 28. At the level of the pressure chamber 40, by means of a cross-sectional reduction, the injection valve member 28 has a pressure shoulder 42 pointing toward the valve seat 36. The end of the injection valve member 28 remote from the combustion chamber is engaged by a prestressed closing spring 44, by which the injection valve member 28 is pressed with its sealing face 34 toward the valve seat 36. The closing spring 44 is disposed in a spring chamber 46 that adjoins the bore 30. The pressure chamber 40 communicates with the pump work chamber 20 via a conduit 48 extending through the valve body 26 and the pump body 16.

Figure 2:
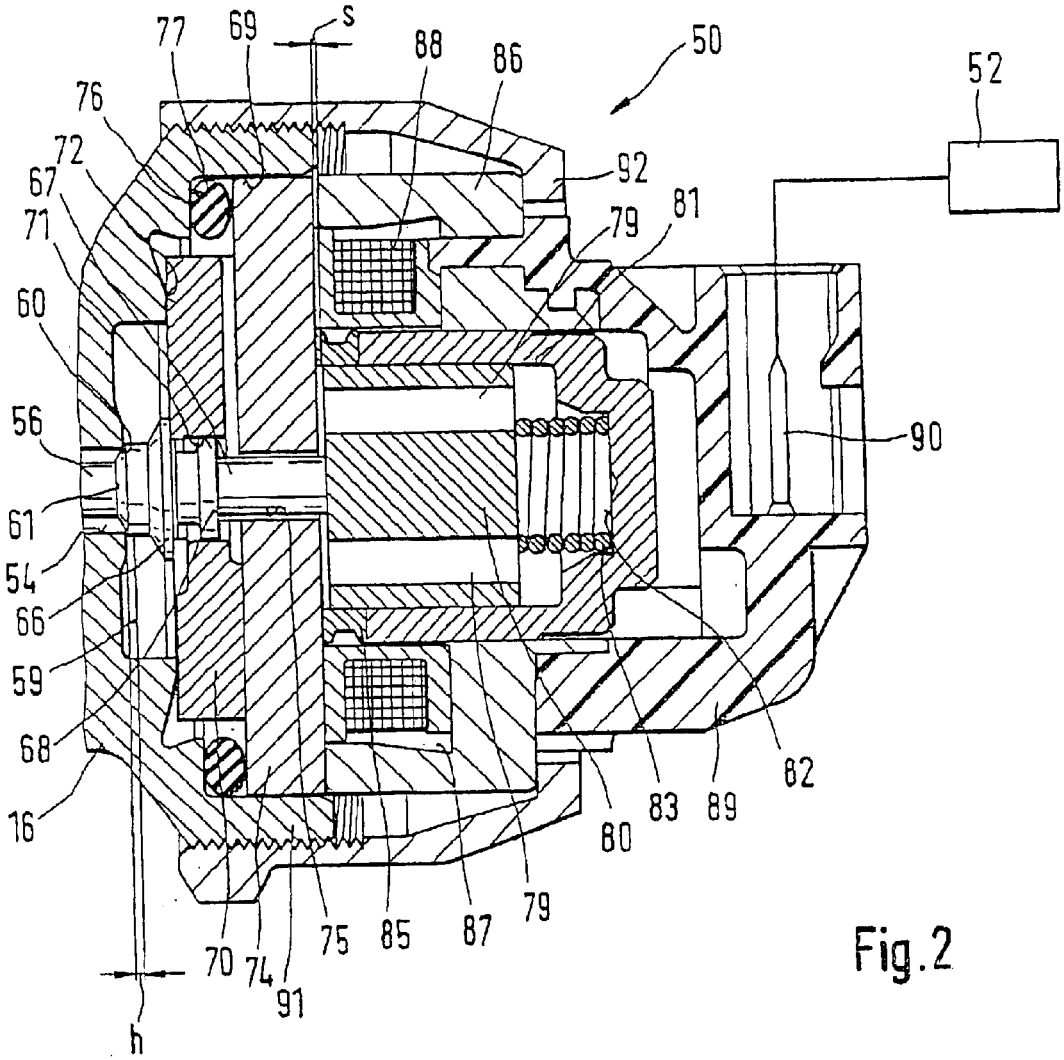
FIG. 2 shows the magnet valve on a larger scale.

For controlling the fuel injection by means of the fuel injection system, the latter has a magnet valve 50, shown enlarged in FIG. 2, which is triggered by an electric control unit 52. By means of the magnet valve 50, a communication of the pump work chamber 20 with a relief chamber is controlled; when the magnet valve 50 is opened, the communication of the pump work chamber 20 with the relief chamber is opened, so that high pressure cannot build up in the pump work chamber 20, and no fuel injection occurs. When the magnet valve 50 is closed, it disconnects the pump work chamber 20 from the relief chamber, so that high pressure can build up in the pump work chamber 20 in accordance with the stroke of the pump piston 18, and a fuel injection can take place. The magnet valve 50 is disposed laterally on the pump body 16, for instance, and has a valve member 56 guided in a bore 54 of the pump body 16. The bore 54 extends transversely, for instance at least approximately perpendicular, to the cylinder bore 14. The bore 54 has a radial enlargement 55, from which a connecting bore 58 leads away into the pump work chamber 20.

The bore 54 discharges into an annular chamber 59, whose cross section is enlarged compared to the bore, in the pump body 16, and the orifice of the bore 54 widens approximately conically, for instance, and forms a valve seat 60. The valve member 56, in its end region protruding from the bore 54 into the annular chamber 59, has a larger cross section than the bore 54, and as a result a sealing face 61, for instance being approximately conical, pointing toward the valve seat 60 is formed on the valve member 56 and cooperates with the valve seat 60. A connecting bore 62 to a relief chamber, as which the fuel supply container can serve at least indirectly, discharges into the annular chamber 59. When the valve member 56 rests with its sealing face 61 on the valve seat 60, the pump work chamber 20 is disconnected from the relief chamber, and when the valve member 56 is spaced apart by its sealing face 61 from the valve seat 60, the pump work chamber 20 communicates with the relief chamber. In the open position of the valve member 56, fuel is aspirated through the connecting bore 62 into the pump work chamber 20 in the intake stroke of the pump piston 18. In the open position of the valve member 56, high pressure cannot build up in the pump work chamber 20 and in the pressure chamber 40, communicating with it via the conduit 48, of the fuel injection valve 12; thus because of the closing spring 44, by which the injection valve member 28 is kept with its sealing face 34 in contact with the valve seat 36, the fuel injection valve 12 is closed, and no fuel injection takes place. In the closed position of the valve member 56, high pressure does build up in the pump work chamber 20 and in the pressure chamber 40 in accordance with the stroke of the pump piston 18. Once the pressure in the pressure chamber 40 is high enough that the force in the opening direction 29, generated by this pressure on the injection valve member 28 via the pressure shoulder 42 is greater than the closing force exerted by the closing spring 44 on the injection valve member 28, the injection valve member 28 with its sealing face 34 lifts away from the valve seat 36 and uncovers the injection openings 32, through which fuel is injected into the combustion chamber. When the pressure in the pressure chamber 40 drops again far enough that the pressure force generated by it via the pressure shoulder 42 is less than the force of the closing spring 44, the fuel injection valve 12 closes again, and the fuel injection is terminated.

The end region of the valve member 56 remote from the magnet valve 50 is engaged by a prestressed compression spring 64, by which the valve member 56 is urged in its opening direction, or in other words in a direction away from the valve seat 60. The spring 64 is braced on one end at least indirectly on the valve member 56 and at the other end on a cap 65, which closes the bore 54 and is inserted into the pump body 16. In its end region protruding into the annular chamber 59, the valve member 56 has a flange 66 of enlarged cross section and adjoining it, in the axial direction away from the sealing face 61, it has a cylindrical portion 67, at which, spaced apart from the flange 66, an annular collar 68 of enlarged cross section is embodied. The annular chamber 59 is embodied in a bore 69 of the pump body 16 that is graduated multiple times in diameter and is limited, axially away from the pump body 16, by a stop disk 70 inserted into a portion of the bore 69 that is somewhat larger in diameter than the annular chamber 59. The stop disk 70 has a bore 71, through which the cylindrical portion 67 of the valve member 56 protrudes. The bore 71 in the stop disk 70 is embodied as only slightly larger in diameter than the annular collar 68 of the valve member 56 that is disposed in the bore 71. The bore 71 in the stop disk 70 is embodied with a smaller diameter than the flange 66 of the valve member 56, which can thus not dip into the bore 71. The stop disk 70, in the axial direction toward the pump body 16, rests on a stop shoulder 72 in the bore 69 on the pump body 16. The valve member 56 is guided with slight play by its annular collar 68 in the bore 71 of the stop disk 70.

The portion of the bore 69 that receives the stop disk 70 is adjoined by a portion of the bore 69 of further-enlarged diameter, into which a magnetic disk 74, as a component of the magnet valve 50, is inserted. The magnetic disk 74 has a bore 75, into which the cylindrical portion 67 of the valve member 56 protrudes. An elastic sealing ring 77 is fastened between the magnetic disk 74 and an annular shoulder 76 that is embodied on the pump body 16 and surrounds the stop disk 70.

The magnet valve 50 has a movable magnet armature 80, on which the valve member 56 rests with the end face of its end that protrudes into the bore 75 of the magnetic disk 74. The magnet armature 80 is embodied as an at least approximately cylindrical piston and is disposed displaceably, at least approximately coaxially to the valve member 56, in a cup-shaped capsule 81. The magnet armature 80, via its outer jacket, is guided displaceably with slight play in the capsule 81. The face end, toward the magnet armature 80, of the magnetic disk 74 and the face end, toward the magnetic disk 74, of the magnet armature 80 are disposed parallel to one another with the highest possible accuracy, and the magnet armature 80 moves with the highest possible accuracy perpendicular to the face end, oriented toward it, of the magnetic disk 74. The magnet armature 80 can have one or more axial through bores 79. The face end of the valve member 56 rests on the face end, toward the magnetic disk 74, of the magnet armature 80. Between the bottom 82 of the capsule 81, disposed on the end of the capsule 81 remote from the magnetic disk 71, and the face end of the magnet armature 80 remote from the magnetic disk 74, a prestressed compression spring 83 is provided, by which the magnet armature 80 is urged toward the magnetic disk 74. The force exerted by the compression spring 83 on the magnet armature 80 is less than the force exerted by the compression spring 64 on the valve member 56. By means of the compression spring 64 acting on the valve member 56 and the compression spring 83 acting on the magnet armature 80, a contact of the valve member 56 with the magnet armature 80 is assured, without these two parts having to be joined together.

Disposed between the capsule 81 and the magnetic disk 74 is a ring 85, which is joined, in particular welded, to the capsule 81 on one side and to the magnetic disk 74 on the other. The ring 85 comprises nonmagnetizable material. The magnetic disk 74 as it were forms a cap that closes the capsule 81, and the magnet armature 80 is disposed in the interior defined by the capsule 81 and the magnetic disk 74. The capsule 81 is inserted into an approximately hollow-cylindrical holder 86, which has an outer diameter that is at least approximately the same size as the outer diameter of the magnetic disk 74. In its inner circumference, toward the magnetic disk 74, the holder 86 has a radial recess 87, into which a magnet coil 88 is inserted. The magnet coil 88 is fixed in the recess axially between the holder 86 and the magnetic disk 74. A connection body 89, preferably of plastic, is connected to the holder 86, and conductor elements are disposed in it that are connected on one side to the magnet coil 88 and on the other to plug contacts 90, with which a plug, not shown, of electric lines leading to the control unit 52 can be connected.

The bore 69 is embodied in an approximately hollow-cylindrical extension 91 of the pump body 16 that is provided with a male thread on its outer circumference. A union nut 92 is slipped onto the holder 86 of the magnet valve 50; it is screwed onto the male thread of the extension 91 of the pump body 16, and thus the magnet valve 50 is secured on the pump body 16 by way of this nut. The union nut 92 engages the holder 86, which is braced on the magnetic disk 74 that is braced in turn on the stop disk 70, which rests on the stop shoulder 72 of the pump body 16. The sealing ring 77 is elastically compressed by the magnetic disk 74 when the latter comes to rest on the stop disk 70.

The function of the magnet valve 50 will now be explained. When there is no current supplied to the magnet coil 88, no magnetic force acts on the magnet armature 80. As a result of the force of the compression spring 64, the valve member 56 is kept in its open position, since the force of the compression spring 64 is greater than the force of the compression spring 83 acting on the magnet armature 80. The magnet armature 80 is thus disposed with axial spacing from the magnetic disk 74. The motion of the valve member 56 and thus of the magnet armature 80 in the opening direction is limited by the provision that the valve member 56, with its flange 66, comes into contact with the stop disk 70. When the magnet valve 50 is to be closed, current is supplied to the magnet coil 88 by the control unit 52, so that a closed magnetic circuit is created through the magnet coil 88, magnetic disk 74 and magnet armature 80, and the magnet armature 80 is attracted by the magnetic disk 74. The force exerted on the magnet armature 80 by the compression spring 83 and the magnetic disk 74 is greater than the force exerted on the valve member 56 by the compression spring 64, so that by means of the magnet armature 80, the valve member 56 is moved into its closed position, in which it rests with its sealing face 61 on the valve seat 60. The stroke that the valve member 56 executes between its open position and its closed position is dimensioned such that even in the closed position, the magnet armature 80 is still disposed with axial spacing from the magnetic disk 74. The residual air gap that is thus present prevents the magnet armature 80 from sticking to the magnetic disk 74 once the magnet coil 88 is without current again and the magnet armature 80 has to be moved away from the magnetic disk 74 again. The stroke h that the valve member 56 executes between its open position and its closed position is determined by the spacing between the valve seat 60, on which the valve member 56 comes to rest with its sealing face 61, on the one hand, and the stop disk 70, on which the valve member 56 comes to rest with its flange 66, on the other. The residual air gap s between the magnet armature 80 and the magnetic disk 74 can be adjusted to the requisite amount by using a stop disk 70 with an adapted thickness. The stop disk 70 can be produced by means of stamping, for instance.

The magnet armature 80 preferably comprises an alloy that contains at least iron and cobalt, and the proportion of the cobalt is between 10 and 50%. Preferably, the proportion of cobalt is between 15 and 20%, and a proportion of cobalt of approximately 17% is especially advantageous. The percentages for the cobalt proportion are referred to the weight. As a result, the magnet armature 80 has especially advantageous magnetic properties. By means of the control unit 52, the course over time of the current flow through the magnet coil 88 is detected and evaluated. The magnet armature 80 is a movable part of the magnetic circuit, by which upon its motion the inductance of the magnetic circuit is altered, which leads to a defined course over time of the current flow through the magnet coil 88. When the magnet armature 80 no longer moves, the inductance no longer changes, and a characteristic change in the course over time of the current flow through the magnet coil 88 occurs. For controlling the fuel injection, a factor of particular significance is the instant when the magnet valve 50 is closed, so that high pressure builds up in the pump work chamber 20 and the fuel injection begins. From the characteristic change in the current flow through the magnet coil 88, it can be ascertained when the magnet armature 80, and thus the valve member 56, has reached the closed position. When the magnet armature 80 is produced from the material recited above, an extremely pronounced change in the flow of current through the magnet coil 88 occurs when the magnet armature 80 is no longer in motion, so that the instant of closure of the magnet valve 50 and thus the instant of injection onset can be determined with high accuracy.

The hardness of the material of which the magnet armature 80 consists in order to attain the favorable magnetic properties is less than the hardness of the material of which the valve member 56 consists. To prevent excessively high wear of the magnet armature 80 from the contact of the valve member 56 with it, it is preferably provided than the surface hardness of the magnet armature 80 is increased, at least in the region of contact with the valve member 56.

Figure 3:
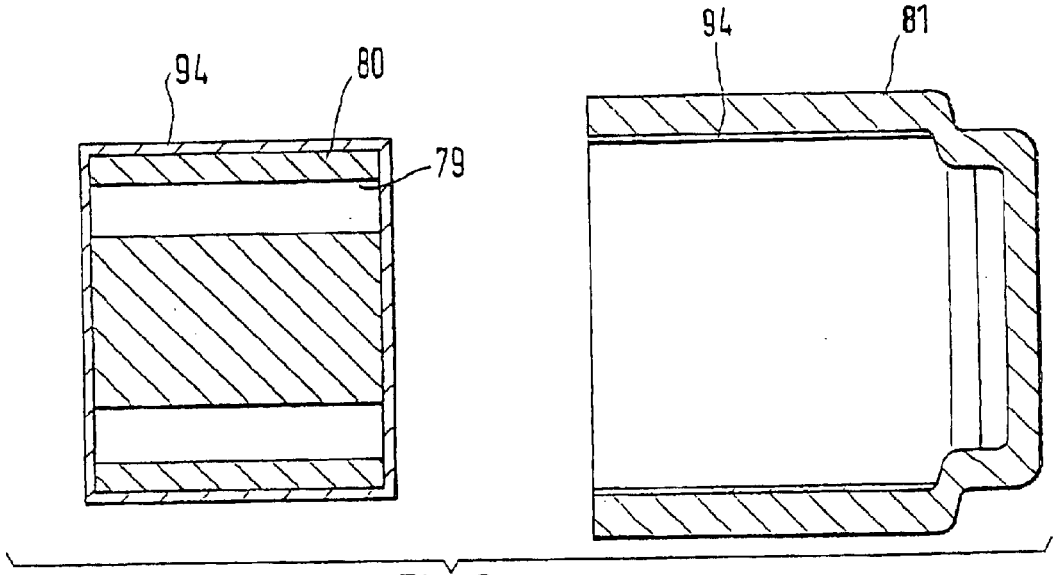
FIG. 3 shows a magnet armature of the magnet valve on a larger scale, in a modified version.

To prevent excessively high wear from occurring at the magnet armature 80 and/or the capsule 81 because of the guidance of the magnet armature 80, provisions for increasing the surface hardness are provided on the magnet armature 80 and/or on the capsule 81, as shown in FIG. 3. In FIG. 3, the magnet armature 80 and the capsule 81 are shown in an exploded view, for simplicity. It may be provided here that the magnet armature 80, at least in some regions, has a coating 94 comprising a material which has a greater hardness than the material, that is, the iron-cobalt alloy, of which the magnet armature 80 consists. As the material for the coating 94, a metal can be used, in particular nickel or chromium. A surface hardness of the magnet armature 80 of approximately 700 HV, for instance, can be achieved. The coating 94 may be applied only to the outer jacket of the magnet armature 80, by way of which the magnet armature is guided in the capsule 81, or can also be applied to the end face of the magnet armature 80 on which the valve member 56 rests, or it can be applied over the entire surface of the magnet armature 80. It can also be provided that the capsule 81 is provided with a coating 94 on its inner circumference that guides the magnet armature 80. The coating 94 is applied preferably to at least the part of the magnet armature 80 and the capsule 81 that has the lesser hardness.

Instead of the coating 94, the magnet armature 80 and/or the capsule 81 can also be treated entirely or in some regions with a method for increasing its surface hardness. The magnet armature 80 and/or the capsule 81 can be subjected to a heat treatment process and can for instance be case-hardened or treated by gas nitrocarburization or carbonitriding. It is possible to increase the surface hardness of the magnet armature 80 and/or of the capsule 81 on only its outer jacket or inner circumference, respectively, where the guidance of the magnet armature 80 takes place. Alternatively, the surface hardness can be increased over a larger region of the surface, or over the entire surface of the magnet armature 80, and in particular also on the end face of the magnet armature 80 on which the valve member 56 rests. The capsule 81 can for instance comprise plasma nitrided steel.

The magnet armature 80 and/or the capsule 81 can also be subjected entirely or in some regions to a cold hardening method and treated for instance by means of shot peening or impact hardening. This treatment, as well, of the magnet armature 80 and/or capsule 81 can be done only on the outer jacket of the magnet armature 80 or on the inner circumference of the capsule 81 where the guidance of the magnet armature 80 occurs. Alternatively, however, the cold hardening can also be done over a larger region of the surface, or over the entire surface of the magnet armature 80.

The use of the above-described magnet valve 50, with the magnet armature 80 guided in the capsule 81, is not limited to the described embodiment of the fuel injection system in the form of the unit fuel injector; on the contrary, it can also be provided in arbitrary other versions of fuel injection systems.

The foregoing relates to preferred exemplary embodiment of the invention, it being understood that other variants and embodiments thereof are possible within the spirit and scope of the invention, the latter being defined by the appended claims.

What is claimed is:

1. A fuel injection system for an internal combustion engine, having at least one magnet valve (50) for controlling the fuel injection, the magnet valve (50) being triggered by an electric control unit (52), the magnet valve comprising a magnet coil (88), a movable pistonlike magnet armature (80) by which armature a valve member (56) is movable between at least two positions, a magnetic disk (74) by which the magnet armature (80) is attracted when current flows through the magnet coil (88), and a cup-shaped capsule (81) into which the magnet armature (80) dips and in which the magnet armature (80) is guided at least indirectly displaceably, the magnet armature (80) is guided displaceably via its outer jacket in the capsule (81).

2. The fuel injection system of claim 1, wherein the magnet armature (80), at least on its outer jacket, and/or the capsule (81) on its inner jacket, is provided with a coating (94) of a metal of greater hardness compared to the material of which the magnet armature (80) or the capsule (81) consists.

3. The fuel injection system of claim 2, wherein the coating (94) comprises chromium or nickel.

4. The fuel injection system of claim 1, wherein the magnet armature (80), at least on its outer jacket, and/or the capsule (81), and its inner jacket, is treated with a method for increasing the surface hardness.

5. The fuel injection system of claim 4, wherein the magnet armature (80) and/or the capsule (81) is case-hardened.

6. The fuel injection system of claim 4, wherein the magnet armature (80) and/or the capsule (81) is treated with a nitriding method, in particular with a gas nitrocarburization method or a carbonitriding method.

7. The fuel injection system of claim 4, wherein the magnet armature (80) and/or the capsule (81) is treated with a cold hardening method, in particular a ball irradiation method or an impact hardening method.

8. The fuel injection system claim 1, wherein the magnet armature (80) at least essentially comprises an alloy that contains at least iron and cobalt, in which the proportion of cobalt amounts to between 10% and 50%.

9. The fuel injection system of claim 2, wherein the magnet armature (80) at least essentially comprises an alloy that contains at least iron and cobalt, in which the proportion of cobalt amounts to between 10% and 50%.

10. The fuel injection system of claim 3, wherein the magnet armature (80) at least essentially comprises an alloy that contains at least iron and cobalt, in which the proportion of cobalt amounts to between 10% and 50%.

11. The fuel injection system of claim 4, wherein the magnet armature (80) at least essentially comprises an alloy that contains at least iron and cobalt, in which the proportion of cobalt amounts to between 10% and 50%.

12. The fuel injection system of claim 5, wherein the magnet armature (80) at least essentially comprises an alloy that contains at least iron and cobalt, in which the proportion of cobalt amounts to between 10% and 50%.

13. The fuel injection system of claim 6, wherein the magnet armature (80) at least essentially comprises an alloy that contains at least iron and cobalt, in which the proportion of cobalt amounts to between 10% and 50%.

14. The fuel injection system of claim 7, wherein the magnet armature (80) at least essentially comprises an alloy that contains at least iron and cobalt, in which the proportion of cobalt amounts to between 10% and 50%.

* * * * *